US007169243B2

(12) United States Patent
Bouzekri

(10) Patent No.: US 7,169,243 B2
(45) **Date of Patent: *Jan. 30, 2007**

(54) ALUMINUM-KILLED MEDIUM-CARBON STEEL SHEET FOR CONTAINERS AND PROCESS FOR ITS PREPARATION

(75) Inventor: Mohamed Bouzekri, Rombas (FR)

(73) Assignee: Sollac, Puteaux (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/866,244

(22) Filed: Jun. 14, 2004

(65) Prior Publication Data

US 2004/0221928 A1 Nov. 11, 2004

Related U.S. Application Data

(63) Continuation of application No. 10/699,884, filed on Nov. 4, 2003, now Pat. No. 6,776,856, which is a continuation of application No. 09/609,401, filed on Jul. 3, 2000, now Pat. No. 6,673,170.

(30) Foreign Application Priority Data

Jul. 1, 1999 (FR) ..... 99 08415

(51) Int. Cl.
*C21D 8/02* (2006.01)

(52) U.S. Cl. ..... 148/603; 148/652

(58) Field of Classification Search ..... 148/320, 148/603, 652, 661

See application file for complete search history.

(56) References Cited

U.S. PATENT DOCUMENTS 3,615,925 A 10/1971 Garber et al.
3,865,645 A 2/1975 Takahashi et al.
4,050,959 A * 9/1977 Nakaoka et al. ..... 148/603
4,113,523 A 9/1978 Uchida et al.
4,931,107 A * 6/1990 Yamada et al. ..... 148/504
6,110,299 A * 8/2000 Tosaka et al. ..... 148/320
6,398,887 B1 6/2002 Bouzekri
6,478,901 B1 11/2002 Bouzekri

FOREIGN PATENT DOCUMENTS

DE 19622164 5/1997
EP 0171197 2/1986

(Continued)

OTHER PUBLICATIONS

U.S. Appl. No. 09/610,224, filed Jul. 3, 2000, Bouzekri.
U.S. Appl. No. 09/610,343, filed Jul. 3, 2000, Bouzekri.
U.S. Appl. No. 10/866,244, filed Jun. 14, 2004, Bouzekri.

*Primary Examiner*—Roy King
*Assistant Examiner*—Michael P. Alexander
(74) *Attorney, Agent, or Firm*—Oblon, Spivak, McClelland, Maier & Neustadt, P.C.

(57) ABSTRACT

A process is provided for preparation of an aluminum-killed medium-carbon steel sheet containing by weight from 0.040 to 0.080% of carbon, from 0.35 to 0.50% of manganese, from 0.040 to 0.070% of aluminum, from 0.004 to 0.006% of nitrogen, the remainder being iron and the inevitable trace impurities, wherein the steel contains carbon in free state, a grain count per $mm^2$ greater than 20000 and, in the aged condition, has a percentage elongation A % satisfying the relationship:

$$(640-Rm)/10 \leq A\,\% \leq (700-Rm)/11$$

where Rm is the maximum rupture strength.

13 Claims, 3 Drawing Sheets

FOREIGN PATENT DOCUMENTS

| | | | |
|---|---|---|---|
| EP | 906 961 | | 4/1999 |
| JP | 55-152129 | * | 11/1980 |
| JP | 57-123957 | * | 8/1982 |
| JP | 58-042753 | * | 3/1983 |
| JP | 60-204835 | * | 10/1985 |
| JP | 01184229 | | 7/1989 |
| JP | 03-202421 | * | 9/1991 |
| JP | 06-145809 | * | 5/1994 |

* cited by examiner

ALUMINUM-KILLED MEDIUM-CARBON STEEL SHEET FOR CONTAINERS AND PROCESS FOR ITS PREPARATION

This application is a Continuation application of U.S. Ser. No. 10/699,884, filed on Nov. 4, 2003, now U.S. Pat. No. 6,776,856 which is a Continuation application of U.S. Ser. No. 09/609,401, filed on Jul. 3, 2000, now U.S. Pat. No. 6,673,170.

BACKGROUND OF THE INVENTION

1. Field of the Invention

The present invention relates to a process for the preparation of aluminum-killed medium carbon steel sheets and the steel sheets prepared thereby, and in particular their use in the field of metal containers for food, non-food products or industrial purposes.

2. Discussion of the Background

Steels smelted for uses specific to metal containers differ from thin sheets, particularly in their physical characteristics.

The thicknesses of steel sheets for containers vary from 0.12 mm to 0.25 mm for the great majority of uses, but can reach greater thicknesses, as much as 0.49 mm, for very special applications. This is the case, for example, in certain containers for non-food products, such as certain aerosols, or in the case of certain industrial containers. The thickness can also be as small as 0.08 mm, in the case of food receptacles, for example.

Steel sheets for containers are usually coated with a metal coat (tin, which may or may not be remelted, or chrome), on which there is generally deposited an organic coat (varnish, inks, plastic films).

In the case of two-piece containers, these are made by deep-drawing under a blank holder or by deep-drawing/trimming for beverage cans, and are generally cylindrical or frustoconical, axially symmetric cans. Container designers are showing increasing interest in even thinner steels, however, with thickness from 0.12 mm to 0.075 mm and, with the objective of distinguishing themselves from the competitors, they are trying to introduce increasingly more complex shapes. Thus one can now find cans of original shapes, manufactured from steel sheets of small thickness, which sheets, even though presenting greater forming difficulties, must meet the use criteria (mechanical durability of the containers, resistance to the axial load to which they are subjected during storage in stacks, resistance to the internal overpressure to which they are subjected during sterilizing heat treatment and to the internal partial vacuum to which they are subjected after cooling) and therefore must have very high mechanical strength.

Thus the use and performance of these containers depend on a variety of mechanical characteristics of the steel, including but not limited to:

coefficient of planar anisotropy, ΔC aniso,

Lankford coefficient, yield strength Re, maximum rupture strength Rm, elongation A %, distributed elongation Ag %.

To impart to the container equivalent mechanical strength at smaller steel thickness, it is indispensable that the steel sheet present a higher maximum rupture strength.

It is known that containers can be made by using standard aluminum-killed medium-carbon and low-manganese steels.

The carbon content customarily sought for this type of steel ranges between 0.040% and 0.080%, because contents in excess of 0.080% lead to problems of electric weldability, which is a latent defect with respect to the production of three-piece food containers, the body of which is a welded shell. In addition, a high carbon content brings about difficulties in cold rolling. Contents of less than 0.040% bring about a decrease in the hardness of the steel.

The manganese is reduced as much as possible because of an unfavorable effect of this element on the value of the Lankford coefficient for steels not degassed under vacuum. Thus the manganese content sought ranges between 0.35 and 0.60%.

These steel sheets are made by cold rolling a hot strip to a cold-rolling ratio of between 75% and more than 90%, followed by continuous annealing at a temperature of between 640 and 700° C., and a second cold-rolling with a percentage elongation which varies between 2% and 45% during this second cold-rolling, depending on the desired level of maximum rupture strength Rm.

For aluminum-killed medium-carbon steels, however, high mechanical characteristics are associated with poor elongation capacity. This poor ductility, apart from the fact that it is unfavorable to forming of the container, leads during such forming to thinning of the walls, a phenomenon which will be unfavorable to the performances of the container.

Thus for example, an aluminum-killed medium-carbon steel with a maximum rupture strength Rm on the order of 550 MPa will have a percentage elongation A % on the order of only 1 to 3%.

SUMMARY OF THE INVENTION

Accordingly, one objective of the present invention is to provide an aluminum-killed medium-carbon steel sheet for containers which has, at a level of maximum rupture strength equivalent to that of aluminum-killed medium-carbon steels of the prior art, a higher percentage elongation A %.

A further objective of the present invention is to provide a process for production of the above-noted aluminum-killed medium-carbon steel sheet.

These and other objects of the present invention have been satisfied by the discovery of A process for manufacturing an aluminum-killed medium-carbon steel strip comprising:

supplying a hot-rolled steel strip comprising by weight from 0.040 to 0.080% of carbon, from 0.35 to 0.50% of manganese, from 0.040% to 0.070 of aluminum, from 0.0035 to 0.0060% of nitrogen, and the remainder being iron and trace impurities, passing the strip through a first cold-rolling, and annealing the cold-rolled strip;

wherein the annealing step is a continuous annealing using a cycle comprising a temperature rise up to a first temperature higher than an onset temperature of pearlitic transformation $Ac_1$, holding the strip above the first temperature for a duration of longer than 10 seconds, and rapidly cooling the strip to a second temperature of below 350° C. at a cooling rate in excess of 100° C. per second.

BRIEF DESCRIPTION OF THE FIGURES

The characteristics and advantages will be made more clearly apparent in the description hereinafter, given exclusively by way of example, with reference to the attached figures.

DETAILED DESCRIPTION OF THE PREFERRED EMBODIMENTS

Figure 1:
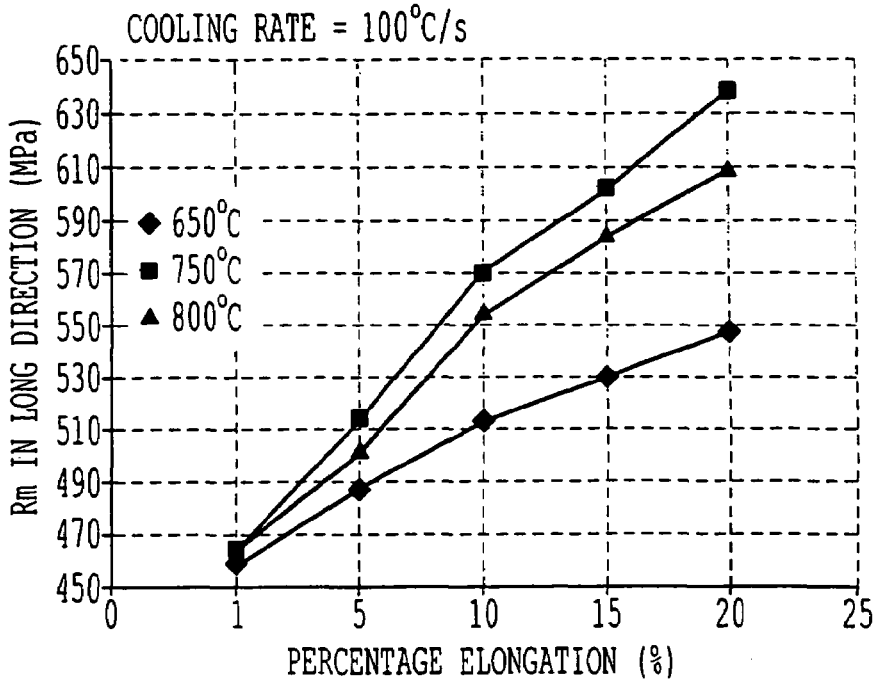
FIG. 1 is a diagram showing the influence of annealing temperature on maximum rupture strength Rm.

The present invention relates to a process for manufacturing an aluminum-killed medium-carbon steel strip for containers, comprising:

supplying a hot-rolled steel strip containing by weight from 0.040 to 0.080%, preferably from 0.045 to 0.075%, of carbon, from 0.35 to 0.50%, preferably from 0.40 to 0.45%, of manganese, from 0.040 to 0.070%, preferably from 0.040 to 0.060%, of aluminum, and from 0.0035 to 0.0060%, preferably from 0.0045 to 0.0060%, of nitrogen, the remainder being iron and the inevitable trace impurities, passing the strip through a first cold-rolling, annealing the cold-rolled strip, and optionally, performing a secondary cold-rolling, wherein the annealing is a continuous annealing using a cycle comprising a temperature rise up to a temperature higher than the temperature of onset of pearlitic transformation Ac, holding the strip above this temperature for a duration of longer than 10 seconds, and rapidly cooling the strip to a temperature of below 350° C. at a cooling rate in excess of 100° C. per second, preferably a cooling rate in excess of 125° C.

According to alternate embodiments of the present process:

the strip is maintained during annealing at a temperature of from $A_c$, to 800° C. for a duration ranging from 10 seconds to 2 minutes;

the cooling rate is from 100° C. to 500° C. per second; or the strip is cooled at a rate in excess of 100° C. per second to room temperature.

According to another embodiment, the annealing is a continuous annealing using a cycle comprising:

raising the temperature up to a temperature higher than the temperature of onset of pearlitic transformation $Ac_1$, holding the strip above this temperature for a duration of longer than 10 seconds, rapidly cooling the strip to a temperature of below 100° C. at a cooling rate in excess of 100° C. per second, treating the strip at low temperature ranging between 100° C. and 300° C. for a duration in excess of 10 seconds, and cooling to room temperature.

The invention also relates to an aluminum-killed medium-carbon steel sheet for containers, comprising by weight from 0.040 to 0.080% of carbon, from 0.35 to 0.50% of manganese, from 0.040% to 0.070% of aluminum, from 0.0035 to 0.0060% of nitrogen, the remainder being iron and the inevitable trace impurities, manufactured according to the above mentioned process, wherein the steel sheet has, in aged condition, a percentage elongation A % satisfying the relationship:

$$(640-Rm)/10 \leqq 5\ A\% \leqq (700-Rm)/11$$

where Rm is the maximum rupture strength of the steel, expressed in MPa.

According to other characteristics of the sheet, the steel contains carbon in free state and/or some carbides precipitated at low temperature, and it has a grain count per $mm^2$ greater than 20000.

Influence of the Composition of the Steel

As indicated above, the present invention does not relate principally to the composition of the steel, which is a standard aluminum-killed medium-carbon steel.

As for all aluminum-killed medium-carbon steels, it is essentially the carbon and manganese contents which are important:

The carbon content customarily sought for this type of steel ranges between 0.040% and 0.080%, because contents in excess of 0.080% lead to problems of electric weldability, which is a latent defect with respect to the production of three-piece food container the body of which is a welded shell. In addition, a high carbon content brings about difficulties in cold rolling. Contents of less than 0.040% bring about a decrease in the hardness of the steel.

The manganese is reduced as much as possible because of an unfavorable effect of this element on the value of the Lankford coefficient for steels not degassed under vacuum. Thus the manganese content is preferably between 0.35 and 0.50%.

Nitrogen and aluminum also are two elements which it is expedient to control.

Extra nitrogen is used if it is wished to obtain a hard, aging steel. It generally ranges between 0.0035 and 0.0060%.

Aluminum is used to kill the steel. It generally ranges between 0.040 and 0.070%.

Influence of the Hot-Denaturing Conditions

The continuously annealed aluminum-killed medium-carbon steels are rolled at a temperature above $Ar_3$.

The essential parameter is the coiling temperature, cold coiling between 500 and 620° C. being preferred. In fact, hot coiling, at a temperature above 650° C., presents two drawbacks;

it generates heterogeneities in mechanical characteristics related to the differences between the cooling rates of the core and the extremities of the strip;

it leads to a risk of abnormal grain growth, which can occur for certain combinations (temperature at end of rolling, coiling temperature) and can constitute a latent defect both in hot sheet and in cold sheet.

Nevertheless, hot coiling may be achieved by using, for example, a selective coiling method, in which the temperature is higher at the extremities of the strip.

Influence of the Cold-Rolling Conditions

By virtue of the small final thicknesses to be achieved, the range of cold reduction ratio extends from 75% to more than 90%.

The main factors involved in the definition of the cold reduction ratio quite obviously are the final thickness of the product, which can be influenced by choice of the thickness of the hot product, and also metallurgical considerations.

The metallurgical considerations are based on the influence of the cold reduction ratio on the microstructural condition and, consequently, on the mechanical characteristics after recrystallization and annealing. Thus an increase in cold reduction ratio leads to a lower recrystallization temperature, to smaller grains and to higher values of Re and Rm. In particular, the reduction ratio has a very strong influence on the Lankford coefficient.

In the case of requirements applicable to deep-drawing spurs, it is appropriate, for example, to optimize the steel grade, especially the carbon content, and the reduction ratio of cold rolling with the hardness or the desired mechanical characteristics in order to obtain a metal known as "spur-free metal".

Influence of Annealing

An important characteristic of the invention resides in the annealing temperature. It is important that the annealing temperature be higher than the point of onset of pearlitic transformation $Ac_1$ (on the order of 720° C. for this type of steel).

Another important characteristic of the invention resides in the cooling rate, which must be greater than 100° C./s.

While the strip is being held at a temperature above $Ac_1$ there is formed carbon-rich austenite. The rapid cooling of this austenite allows a certain quantity of carbon to be maintained in the free state and/or fine and disperse carbides to be precipitated at low temperature. This carbon in free state and/or these carbides formed at low temperature favor blocking of dislocations, thus making it possible to achieve high levels of mechanical characteristics without necessitating a large reduction ratio during the ensuing second cold-rolling step.

It is therefore important to perform rapid cooling, between 100 and 500° C./s, at least to a temperature below 350° C. If the rapid cooling is stopped before 350° C., the atoms of free carbon will be able to combine and the desired effect will not be achieved. Rapid cooling to room temperature is also possible.

It is also possible to perform cooling at a rate faster than 500° C./s, but the influence of an increase in cooling rate beyond 500° C./s is not very significant.

Figure 2:
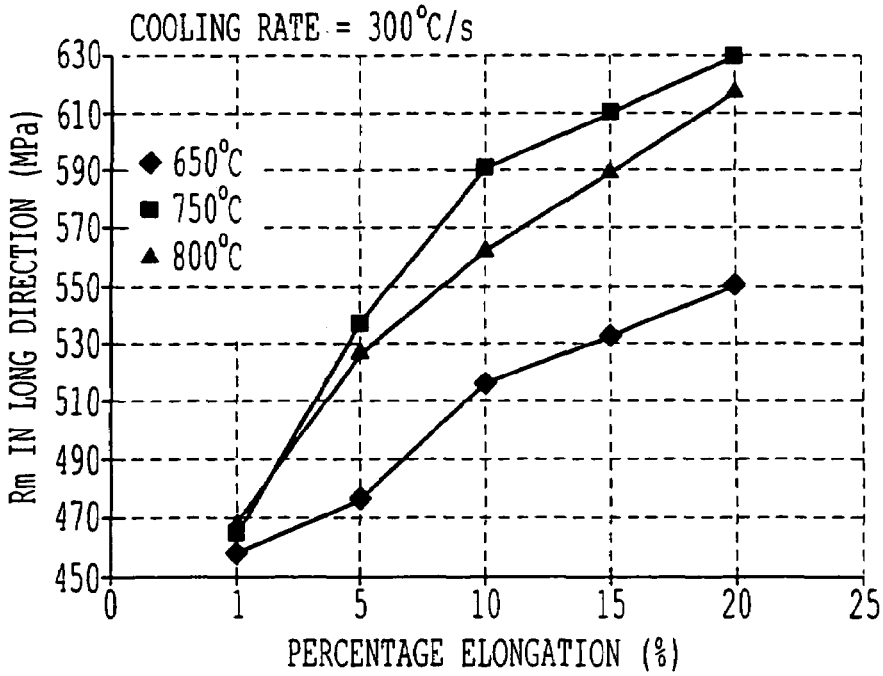
FIG. 2 is a diagram showing the influence of annealing temperature on maximum rupture strength Rm.

FIGS. 1 and 2 show the influence of annealing temperature at constant cooling rate (target rate 100° C./s; actual rate 73 to 102° C./s on FIG. 1 target rate 300° C./s; actual rate 228 331° C./s on FIG. 2) on the maximum rupture strength Rm.

It is evident from these figures that, for identical percentage elongation in the second rolling, Rm is clearly greater for the steels annealed at 740° C. and at 780° C. compared with the same steel annealed at 650° C. and at 680° C.

Nevertheless, this influence of annealing temperature on maximum rupture strength Rm is not very perceptible when the percentage elongation in the second cold-rolling is less than 3%. It becomes truly significant only starting from 5% elongation in the second cold-rolling.

If the temperature is too high (above 800° C.), there occurs at least partial precipitation of the nitrogen in the form of aluminum nitrides. This precipitated nitrogen no longer contributes to hardening of the steel, and the resulting effect is lowering of the maximum rupture strength Rm. There are signs of this phenomenon in FIG. 2, where it is noted that, for percentage elongations greater than 10%, the increase in maximum rupture strength Rm between the sample annealed at 750° C. and the sample annealed at 800° C. becomes smaller.

The time for which the strip is held between 720° C. and 800° C. must be sufficient to return all the carbon corresponding to equilibrium to solution. A holding time of 10 seconds is sufficient to ensure this return to solution of the quantity of carbon corresponding to equilibrium for the steels whose carbon content ranges between 0.040 and 0.080%, and a holding time of longer than 2 minutes, although possible, is impractical and costly.

Figure 3:
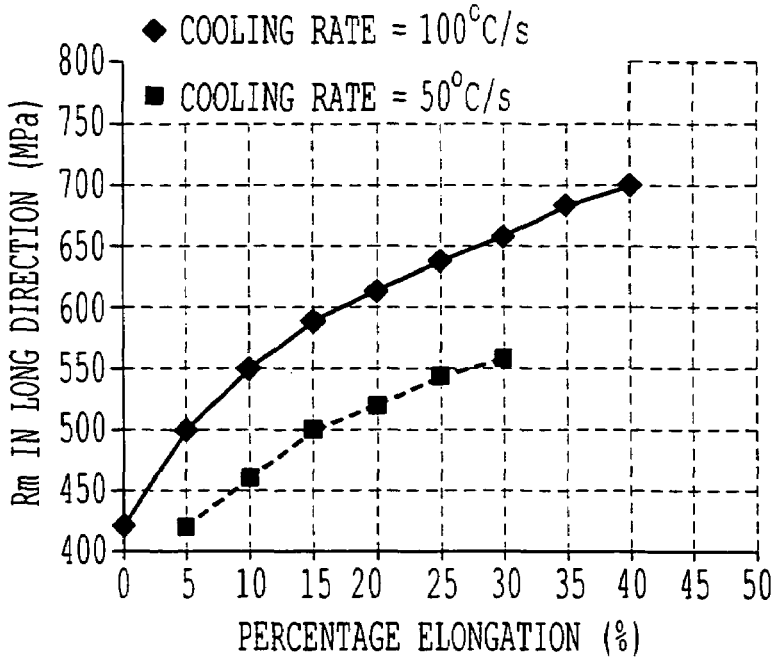
FIG. 3 is a diagram showing the influence of cooling rate on maximum rupture strength Rm.
Figure 4:
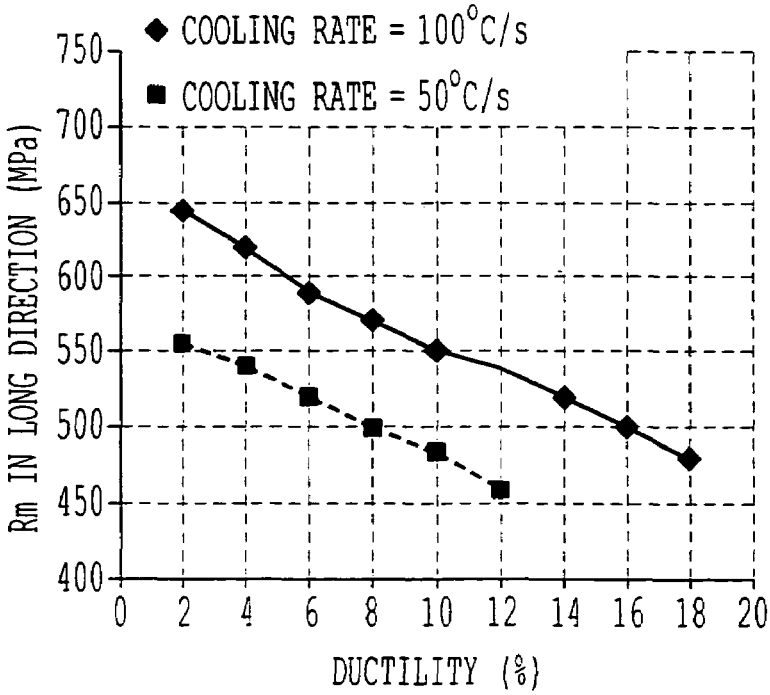
FIG. 4 is a diagram showing the influence of cooling rate on maximum rupture strength Rm and on the percentage elongation A %.

FIGS. 3 and 4 show the influence of cooling rate at constant annealing temperature (750° C.) maintained for 20 seconds.

As can be seen in FIG. 3, at 10% elongation in the second cold-rolling, the maximum rupture strength Rm of the steel is equal to about 550 MPa if the cooling rate is equal to 100° C./s, whereas it reaches only 460 MPa if the cooling rate is equal to 50° C./s.

It is therefore possible to obtain an aluminum-killed medium-carbon steel whose value of Rm is equal to 550 MPa with only 10% elongation in the second cold-rolling if the cooling rate is equal to 100° C./s, whereas a second cold-rolling must be carried out with a percentage elongation of 25% if the cooling rate is only 50° C./s.

By virtue of this smaller percentage elongation in the second cold-rolling step, it is possible to minimize the loss of ductility of the steel. In FIG. 4, for example, it is evident that the steel having an Rm equal to 550 MPa has a ductility A % equal to 10 when the cooling rate is equal to 100° C./s, whereas it is equal to 2.5 when the cooling rate is equal to 50° C./s.

Figure 5:
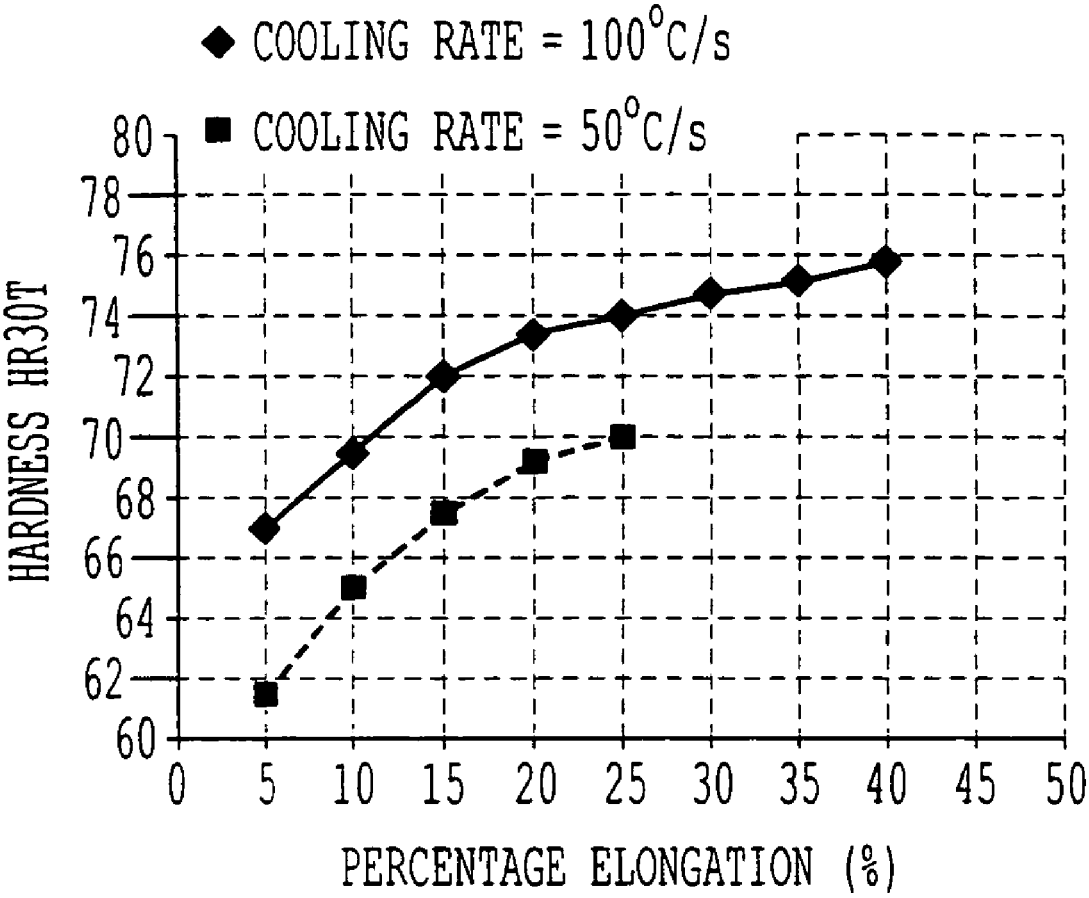
FIG. 5 is a diagram showing the influence of cooling rate on hardness HR30T.

This observation is also valid for the hardness of the steel. As is evident from FIG. 5, for the same percentage elongation in the second cold-rolling, the hardness of the steel increases if the cooling rate is equal to 100° C./s. This increase in hardness is due to a higher content of free carbon and/or to the presence of fine and disperse precipitates.

The steel produced at a cooling rate of 100° C./s may have a hardness of from 67 (HR30T) to 76 (HR30T) when measured at an elongation of from 5 to 40%.

The micrographic analyses of the samples revealed that the grain count per $MM^2$ is larger (greater than 20000), and that the carbides, when they are formed, comprise intergranular gementite.

Thus this manufacturing process makes it possible to obtain an aluminum-killed medium-carbon steel for containers, comprising by weight between 0.040 and 0.080% of carbon, between 0.35 and 0.50% of manganese, between 0.040 and 0.070% of aluminum, between 0.0035 and 0.0060% of nitrogen, the remainder being iron and the inevitable trace impurities, which steel has in the aged condition a percentage elongation A % satisfying the relationship:

$$(640-Rm)/10 \leqq A\% \leqq (700-Rm)/11$$

As an alternative embodiment, it is possible to combine with the rapid cooling a secondary low-temperature thermal treatment, prior to the skin-pass operation.

In this case, the manufacturing process for an aluminum-killed medium-carbon steel strip for containers comprises the following stages:

supplying a hot-rolled steel strip which contains by weight from 0.040 to 0.080% of carbon, from 0.15 to 0.25% of manganese, from 0.040 to 0.070% of aluminum, from 0.0035 to 0.0060% of nitrogen, the remainder being iron and the inevitable trace impurities, passing the strip through a first cold rolling, annealing the cold-rolled strip, and optionally, performing a secondary cold-rolling.

The annealing is preferably a continuous annealing using a cycle comprising:

raising the temperature up to a temperature higher than the temperature of onset of pearlitic transformation $Ac_1$, holding the strip above this temperature for a duration of longer than 10 seconds, rapidly cooling the strip to a temperature of below 100° C. at a cooling rate in excess of 100° C. per second, treating the strip at low temperature ranging from 100° C. to 300° C. for a duration in excess of 10 seconds, and cooling to room temperature.

This additional thermal treatment makes it possible to obtain a metal which is non-aging, even after plating and lacquering treatments.

EXAMPLES

Having generally described this invention, a further understanding can be obtained by reference to certain specific examples which are provided herein for purposes of illustration only and are not intended to be limiting unless otherwise specified.

Several tests were performed, first in the laboratory and then under industrial conditions, in order to show the advantages of the invention. The complete results of two of those tests will now be described.

These tests relate to an aluminum-killed medium-carbon steel, whose characteristics are presented below in Table 1.

TABLE 1

| Contents ($10^{-3}$%) | | | | Hot rolling | | | Cold rolling | |
|---|---|---|---|---|---|---|---|---|
| | | | | Rolling end temp. | Upcoiling temp. | | Red. ratio | Thick-ness |
| C | Mn | Al | N | (°) | (° C.) | Thickness | (%) | (mm) |
| 61 | 437 | 41 | 5.5 | 860/880 | 530/565 | 2.00 | 87 | 0.28 |

In the first through fourth columns are shown the contents in $10^{-3}$ wt % of the main constituents of importance. The fifth through seventh columns relate to the hot-rolling conditions; in the fifth column, the temperature at the end of hot rolling is shown; in the sixth column, the coiling temperature; in the seventh column, the thickness of the hot strip. Finally, columns eight and nine relate to the cold-rolling conditions: in the eighth column is shown the percentage reduction achieved by cold rolling and in the ninth column, the final thickness of the cold strip.

This standard strip was subjected to different annealings followed by second cold-rollings, which were also different.

The holding temperatures in annealing varied from 650° C. to 800° C., the cooling rates varied from 40° C./s to 400° C./s and the percentage elongations in the second rolling varied from 1% to 42%.

In addition to the micrographic examinations, the characterization of the metal obtained from these different tests comprised on the one hand performing tension tests on 12.5×50 ISO specimens in the rolling direction and in the cross direction, in both the fresh condition and in the aged condition after aging at 200° C. for 20 minutes, and on the other hand determining the hardness HR30T, also in both the fresh condition and in the aged condition.

On the basis of these tests it was demonstrated that it is possible to considerably increase the maximum rupture strength Rm for the same aluminum-killed medium-carbon steel with identical percentage elongation in the second cold-rolling, if a continuous annealing according to the conditions of the invention is performed between the two cold-rollings.

On the basis of these tests, it is possible to considerably increase the ductility A % for the same aluminum-killed medium-carbon steel with identical maximum rupture strength Rm if a continuous annealing according to the present invention is performed between the two cold-rollings, because the same level of Rm is achieved with a smaller percentage elongation during the second rolling. Thus it becomes possible to obtain grades of aluminum-killed medium-carbon steel with an Rm level on the order of 400 MPa without necessitating a second rolling step after annealing, other than, perhaps, a light work-hardening operation known as skin pass, in order to suppress the Yield-strength plateau present on the metal upon discharge from annealing.

The present application is based on French patent application serial no. 99 08 415, filed in the French Patent Office on Jul. 1, 1999, the entire contents of which are hereby incorporated by reference.

Obviously, numerous modifications and variations of the present invention are possible in light of the above teachings. It is therefore to be understood that within the scope of the appended claims, the invention may be practiced otherwise than as specifically described herein.

The invention claimed is:

1. A process comprising a first cold-rolling of a hot-rolled steel strip to form a first cold-rolled steel strip;

annealing the first cold-rolled steel strip; and a second cold-rolling of the annealed first cold-rolled steel strip, wherein the hot-rolled steel strip comprises from 0.040 to 0.080% of carbon, from 0.35 to 0.50% of manganese, from 0.040 to 0.070% of aluminum, from 0.0035 to 0.0060% of nitrogen, and the remainder being iron and trace impurities, where % is % by weight based on the total weight of the hot-rolled steel strip;

wherein the annealing is a continuous annealing comprising:

raising the temperature of the first cold-rolled steel strip to a first temperature in a range of from 740° C. to 780° C., then holding the first cold-rolled steel strip above the first temperature for longer than 10 seconds, and then rapidly cooling the first cold-rolled steel strip to a second temperature of below 350° C. at a cooling rate of from 100° C./s to 300° C./s; and wherein the second cold-rolling is at a percentage elongation of from 2 to 16% and results in an aluminum-killed medium carbon steel strip having a maximum rupture strength Rm in a range of from 500 to 650 MPa.

2. The process according to claim 1, wherein the first cold-rolled steel strip is held at the first temperature for from 10 seconds to 2 minutes.

3. The process according to claim 1, wherein the second temperature is room temperature.

4. The process according to claim 1, wherein the second temperature is below 100° C. and the annealing further comprises after the rapid cooling thermally treating the first cold-rolled steel strip at a temperature of from 100° C. to 300° C. for a period in excess of 10 seconds, and then cooling the steel strip to room temperature.

5. The process of claim 1, further comprising:

hot-rolling the steel strip at a temperature above Ar3 before the first cold-rolling and the annealing.

6. The process of claim 5, wherein the hot-rolling is cold coiling at a temperature between 500 and 620° C.

7. The process of claim 1, wherein the cold-rolling provides a cold reduction ratio of from 75% to 90%.

8. The process of claim 1, wherein the annealing forms a steel strip having a carbon-rich austenite.

9. The process of claim 1, wherein the annealed cold-rolled strip has a maximum rupture strength that is greater than the maximum rupture strength of the steel annealed to a first temperature of from 650 to 680° C.

10. The process of claim 1, wherein the steel strip is held at the first temperature for a period sufficient to return all the carbon corresponding to equilibrium to solution.

11. The process of claim 1, wherein the second cold-rolling provides no more than 10% elongation.

12. The process of claim 1, wherein the aluminum-killed medium carbon steel strip has a hardness of 76 HR 30T or greater.

13. The process of claim 1, wherein the aluminum-killed medium carbon steel strip has a hardness of 67 HR 30T or greater.

* * * * *